US010000268B1

(12) United States Patent
Poirier et al.

(10) Patent No.: US 10,000,268 B1
(45) Date of Patent: Jun. 19, 2018

(54) SYSTEMS AND METHODS FOR CONTROLLING A MARINE VESSEL HAVING A JOYSTICK WITH ADJUSTABLE DISPLAY

(71) Applicant: Brunswick Corporation, Lake Forest, IL (US)

(72) Inventors: Brian J. Poirier, Fond du Lac, WI (US); Ryan C. Abellera, Fond du Lac, WI (US); Todd D. Dannenberg, Oshkosh, WI (US); Mark W. Henker, Fond du Lac, WI (US); Yana V. Foltice, Cambellsport, WI (US)

(73) Assignee: Brunswick Corporation, Mettawa, IL (US)

( * ) Notice: Subject to any disclaimer, the term of this patent is extended or adjusted under 35 U.S.C. 154(b) by 427 days.

(21) Appl. No.: 14/830,988

(22) Filed: Aug. 20, 2015

(51) Int. Cl.
*H01H 25/00* (2006.01)
*B63H 25/02* (2006.01)
*H01H 25/04* (2006.01)

(52) U.S. Cl.
CPC ..... *B63H 25/02* (2013.01); *H01H 25/04* (2013.01); *B63H 2025/026* (2013.01); *H01H 2025/048* (2013.01); *H01H 2219/01* (2013.01); *H01H 2219/014* (2013.01); *H01H 2219/018* (2013.01); *H01H 2219/022* (2013.01); *H01H 2219/039* (2013.01); *H01H 2219/0622* (2013.01); *H01H 2221/012* (2013.01)

(58) Field of Classification Search
CPC ..... H01H 25/04; H01H 2025/048; H01H 2219/0622
See application file for complete search history.

(56) References Cited

U.S. PATENT DOCUMENTS

| | | | |
|---|---|---|---|
| D357,947 | S | 5/1995 | Richer |
| D366,655 | S | 1/1996 | Sanchez et al. |
| 5,982,355 | A | 11/1999 | Jaeger et al. |
| D444,785 | S | 7/2001 | Whitehorn et al. |
| D449,614 | S | 10/2001 | Osborn et al. |
| 6,826,042 | B2 | 11/2004 | Oross et al. |
| 6,896,563 | B1 | 5/2005 | Dickson |
| D558,767 | S | 1/2008 | Solland |
| D598,023 | S | 8/2009 | Miller et al. |
| D599,829 | S | 9/2009 | Jorgensen et al. |
| 8,060,265 | B2 | 11/2011 | Hallenstvedt et al. |
| D693,346 | S | 11/2013 | Coulter |
| D698,357 | S | 1/2014 | Mainville et al. |

(Continued)

OTHER PUBLICATIONS

BMW Technology Guide: iDrive, http://www.bmw.com/com/en/insights/technology/technology_guide/articles/idrive, website visited Jun. 10, 2015.

(Continued)

*Primary Examiner* — David M Fenstermacher
(74) *Attorney, Agent, or Firm* — Andrus Intellectual Property Law, LLP

(57) ABSTRACT

A joystick device for controlling propulsion and steering of a marine vessel has a handle configured to be moveable by an operator to provide propulsion and steering control commands for a marine vessel, and a housing at the base of the handle such that the handle extends out of the housing. The joystick device also has an adjustable display thereon that adjusts based on at least one of a control mode and a movement of the handle.

19 Claims, 7 Drawing Sheets

(56) References Cited

U.S. PATENT DOCUMENTS

| | | | | |
|---|---|---|---|---|
| 8,700,238 | B2 | 4/2014 | Hiramatsu | |
| 8,924,054 | B1 | 12/2014 | Arbuckle et al. | |
| 8,925,414 | B1 | 1/2015 | Park et al. | |
| D750,179 | S * | 2/2016 | Foulkes | D14/400 |
| D795,259 | S * | 8/2017 | Vaninetti | D14/412 |
| D798,866 | S * | 10/2017 | Abellera | D14/413 |
| 2005/0080518 | A1* | 4/2005 | Wakefield, II | A61G 5/04 701/1 |
| 2005/0190153 | A1* | 9/2005 | Ushimaru | G05G 9/04796 345/161 |
| 2006/0137931 | A1* | 6/2006 | Berg | B62D 1/12 180/333 |
| 2008/0252600 | A1* | 10/2008 | Hagner | G05G 1/08 345/161 |
| 2008/0288093 | A1 | 11/2008 | Kamentser et al. | |
| 2008/0308400 | A1 | 12/2008 | States et al. | |
| 2009/0055003 | A1 | 2/2009 | Tunick et al. | |
| 2011/0043449 | A1* | 2/2011 | Sip | G05G 1/08 345/161 |
| 2011/0128224 | A1* | 6/2011 | Ludwig | G06F 3/0346 345/161 |
| 2011/0172858 | A1 | 7/2011 | Guston et al. | |
| 2011/0279370 | A1 | 11/2011 | Wang et al. | |

OTHER PUBLICATIONS

Joystick driving—EVC Options: Volvo Penta, http://volvopenta.com/volvopenta/east_europe/en-ee/marine_leisure_engines/accessories, website visited Jun. 10, 2015.

SeaStar Solutions, Optimus 360 Joystick Control System, http://www.seastartsolutions.com/products/electronic-power-steering/optimus-360-outboard, website visited Jun. 10, 2015.

* cited by examiner

SYSTEMS AND METHODS FOR CONTROLLING A MARINE VESSEL HAVING A JOYSTICK WITH ADJUSTABLE DISPLAY

BACKGROUND

U.S. Pat. No. 8,700,238 is incorporated herein by reference in its entirety and discloses a marine vessel propulsion control apparatus arranged to control a propulsion unit and a steering unit. The marine vessel propulsion control apparatus includes a joystick unit, and a control unit programmed to control an output of the propulsion unit and a steering angle of the steering unit in accordance with an output signal of the joystick unit. The joystick unit includes a lever that is tiltable from a neutral position and arranged to be operated by a marine vessel operator to command a heading direction and stem turning of a hull. The control unit is programmed to maintain the steering angle of the steering unit when the output of the propulsion unit is stopped.

U.S. Pat. No. 7,497,746 is incorporated herein by reference in its entirety and discloses a method of steering a watercraft propulsion device mounted to a transom plate and having a steering drive unit which allows the watercraft propulsion device to rotationally move about a swivel shaft. The method can include calculating a steering control amount for the steering drive unit in accordance with the degree of operator's steering wheel displacement and a predetermined steering system response performance, and operating the steering drive unit based on the calculated control physical quantity, in which the predetermined steering system response performance can be, selected from a plurality of plurality of predetermined steering system response performance options.

U.S. Patent Publication No. 2009/0197486 is incorporated herein by reference in its entirety and discloses an aquatic vessel (500) that includes a hull (20) and two engines (30, 50), the engine (30, 50) outputs being rotationally couplable to corresponding propeller units (332, 352) which are mounted so as to be angularly moveable in respect of the hull (20). The vessel (500) includes a control unit (70) for controlling operation of the engines (30, 50) and angles (.alpha..sub.1, .alpha..sub.2) of the propeller units (332, 352) with respect to the hull (20). The vessel (500) is configurable to operate in a first mode wherein directions of thrust developed by the propeller units (332, 352) are mutually substantially parallel for propelling the vessel (500) through water, and a second "fishing" mode of operation wherein the directions of thrust developed by the propeller units (332, 352) are configured to mutually diverge with respect to a longitudinal axis from a rear end of the vessel (500) to a forward end thereof for providing the vessel (500) with a turning characteristic (160) in operation. The control unit (70) is configured to receive in operation user-instructions for commanding the control unit (70) to operate in the second mode for causing the propeller units (3320, 352) to be angularly orientated in a divergent manner in respect of the longitudinal direction. The control unit (70) controls rotation of the vessel (500) by controlling power coupled from the two engines (30, 50) and delivered to their propeller units (332, 352) and forward/reverse coupling of the propeller units (332, 352).

U.S. Pat. No. 8,925,414 is incorporated herein by reference in its entirety and discloses a device for inputting command signals to a marine vessel control system that includes a lever that is selectively operable in a joystick mode and a lever mode. In the lever mode, the lever is confined to pivoting about a horizontal axis to thereby input throttle and shift commands to the control system. In the joystick mode, the lever is freely pivotable in all directions away from a vertical axis that is perpendicular to the horizontal axis to thereby input throttle, shift, and directional commands to the control system.

U.S. Pat. No. 8,807,059 is incorporated herein by reference in its entirety and discloses systems for maneuvering a marine vessel comprise an input device for requesting lateral movement of the marine vessel with respect to the longitudinal axis and a plurality of propulsion devices including at least a port propulsion device, a starboard propulsion device and an intermediate propulsion device disposed between the port and starboard propulsion devices. A control circuit controls orientation of the port and starboard propulsion devices inwardly towards a common point on the marine vessel, and upon a request for lateral movement of from the input device, operates one of the port and starboard propulsion devices in forward gear, operates the other of the port and starboard propulsion devices in reverse gear, and operates the intermediate propulsion device in reverse gear.

U.S. Pat. No. 7,467,595 is incorporated herein by reference in its entirety and discloses a method for controlling the movement of a marine vessel that rotates one of a pair of marine propulsion devices and controls the thrust magnitudes of two marine propulsion devices. A joystick is provided to allow the operator of the marine vessel to select port-starboard, forward-reverse, and rotational direction commands that are interpreted by a controller which then changes the angular position of at least one of a pair of marine propulsion devices relative to its steering axis.

U.S. Pat. No. 7,467,596 is incorporated herein by reference in its entirety and discloses a trim tab control system that determines current tab position based upon a feedback signal that represents incremental motion of the actuator drive motor. Prior to power down, the current tab position is stored in non-volatile memory, and is retrieved on power up. The control system characterizes the actuator during a learning function by driving the actuator between the upper and lower limit positions and counting the number of increments. The display of tab position is based upon the current tab position count and the number of increments in a full range of motion. Automatic up and down commands cause the actuator to be driven up or down until a stop command is received or a limit position is reached.

U.S. Pat. No. 7,305,928 is incorporated herein by reference in its entirety and discloses a vessel positioning system that maneuvers a marine vessel in such a way that the vessel maintains its global position and heading in accordance with a desired position and heading selected by the operator of the marine vessel. When used in conjunction with a joystick, the operator of the marine vessel can place the system in a station keeping enabled mode and the system then maintains the desired position obtained upon the initial change in the joystick from an active mode to an inactive mode. In this way, the operator can selectively maneuver the marine vessel manually and, when the joystick is released, the vessel will maintain the position in which it was at the instant the operator stopped maneuvering it with the joystick.

U.S. Pat. No. 7,037,150 is incorporated herein by reference in its entirety and discloses a control system and apparatus for controlling waterjet-driven marine vessels. Some aspects allow for generation of a plurality of actuator control signals from a single vessel control signal, such as those provided by vessel control apparatus. A control stick embodiment provides a control apparatus that comprises a shaft moveable in at least one degree of freedom to provide the vessel control signals. Some aspects allow for an intuitive direct movement of the vessel in correspondence to movements of the control apparatus. Yet other aspects allow for locking out on or more degrees of freedom while other degrees of freedom and not locked out.

U.S. Pat. No. 6,975,959 is incorporated herein by reference in its entirety and discloses a mobile device for enhanced navigation and orientation including a visualization interface, a first sensor for providing signals indicative of a movement of the mobile device, a second sensor for providing further signals indicative of a movement of the mobile device, and a processor receiving signals from the first and second sensors, calculating a position and an orientation of the mobile device from the received signals, and generating a real time simulation of an environment via the visualization interface based on the position and orientation of the mobile device. According to an embodiment, the first and second sensors are implemented as an inertial sensor and a GPS receiver, respectively.

U.S. Pat. No. 7,727,036 is incorporated herein by reference in its entirety and discloses a system and method for controlling movement of a marine vessel. An operator controllable device outputs a signal that is representative of an operator-desired rate of position change of the vessel about or along an axis. A sensor outputs a signal that is representative of a sensed actual rate of position change of the vessel about or along the axis. A rate of position change controller outputs a rate of position change command based upon the difference between the desired rate of position change and the sensed rate of position change. A vessel coordination controller controls movement of the vessel based upon the rate of position change command.

U.S. Patent Publication No. 2011/0172858 is incorporated herein by reference in its entirety and discloses a marine propulsion and steering system for a vessel having multiple modes of operation, an axial propulsion system, a maneuvering propulsion system and a maneuvering control system including a pilot controllable joystick for generating propulsion and maneuvering control commands representing vessel motions desired by a pilot. An input loop is responsive to the joystick control commands to generate maneuvering commands representing the magnitudes and directions of motions of the vessel desired by the pilot and the actuator loop controller is responsive to the maneuvering commands from the input loop to generate corresponding vessel control commands to the vessel propulsion and maneuvering systems.

U.S. Pat. No. 8,924,054 is incorporated herein by reference in its entirety and discloses systems and methods for orienting a marine vessel having a marine propulsion device. A control circuit controls operation of the marine propulsion device. A user input device inputs to the control circuit a user-desired global position and a user-desired heading of the marine vessel. The control circuit calculates a position difference between the user-desired global position and an actual global position of the marine vessel and controls the marine propulsion device to minimize the position difference. The control circuit controls the marine propulsion device to orient an actual heading of the marine vessel towards the user-desired global position when the position difference is greater than a threshold. When the position difference is less than the threshold, the control circuit controls the marine propulsion device to minimize a difference between the actual heading and the user-desired heading while minimizing the position difference.

U.S. Pat. No. 8,777,681 is incorporated herein by reference in its entirety and discloses systems for maneuvering a marine vessel comprising a plurality of marine propulsion devices that are movable between an aligned position to achieve of movement of the marine vessel in a longitudinal direction and/or rotation of the marine vessel with respect to the longitudinal direction and an unaligned position to achieve transverse movement of the marine vessel with respect to the longitudinal direction. A controller has a programmable circuit and controls the plurality of marine propulsion devices to move into the unaligned position when a transverse movement of the marine vessel is requested and to thereafter remain in the unaligned position after the transverse movement is achieved. Methods of maneuvering a marine vessel comprise requesting transverse movement of the marine vessel with respect to a longitudinal direction and operating a controller to orient a plurality of marine propulsion devices into an unaligned position to achieve the transverse movement, wherein the plurality of marine propulsion devices remain in the unaligned position after the transverse movement is achieved.

U.S. Pat. No. 8,478,464 is incorporated herein by reference in its entirety and discloses systems and methods for orienting a marine vessel to enhance available thrust in a station keeping mode. A control device having a memory and a programmable circuit is programmed to control operation of a plurality of marine propulsion devices to maintain orientation of a marine vessel in a selected global position. The control device is programmed to calculate a direction of a resultant thrust vector associated with the plurality of marine propulsion devices that is necessary to maintain the vessel in the selected global position. The control device is programmed to control operation of the plurality of marine propulsion devices to change the actual heading of the marine vessel to align the actual heading with the thrust vector.

U.S. Pat. No. 8,417,399 is incorporated herein by reference in its entirety and discloses systems and methods for orienting a marine vessel to minimize at least one of pitch and roll in a station keeping mode. A control device having a memory and a programmable circuit is programmed to control operation of the plurality of marine propulsion devices to maintain orientation of a marine vessel in a selected global position and heading. The control device receives at least one of actual pitch and actual roll of the marine vessel in the global position and controls operation of the plurality of marine propulsion units to change the heading of the marine vessel to minimize at least one of the actual pitch and the actual roll while maintaining the marine vessel in the selected global position.

U.S. Pat. No. 8,050,630 is incorporated herein by reference in its entirety and discloses a method for determining the validity of a signal received by a GPS receiver. A signal that is unfiltered, either mathematically or electronically, is monitored to determine the variability of different occurrences of the signal. These occurrences, which may be sequential, are compared to each other in order to detect whether or not variation exists between one occurrence of the signal and a subsequent occurrence of the signal. If no variation exists, it is determined that the signal is invalid and that a loss of fix of the satellite signal has occurred. If sufficient variability exists in the signal, between successive occurrences, the signal is deemed to be valid and suitable for use to control a vehicle such as a marine vessel.

U.S. Pat. No. 7,267,068 is incorporated herein by reference in its entirety and discloses a marine vessel maneuvered by independently rotating first and second marine propulsion devices about their respective steering axes in response to commands received from a manually operable control device, such as a joystick. The marine propulsion devices are aligned with their thrust vectors intersecting at a point on a centerline of the marine vessel and, when no rotational movement is commanded, at the center of gravity of the marine vessel. Internal combustion engines are provided to drive the marine propulsion devices. The steering axes of the two marine propulsion devices are generally vertical and parallel to each other. The two steering axes extend through a bottom surface of the hull of the marine vessel.

U.S. Pat. No. 8,145,371 is incorporated herein by reference in its entirety and discloses a dynamic control system for a marine vessel having two or more waterjet units as the primary propulsion system of the vessel, for maintaining vessel position or velocity when in a dynamic control mode, comprises a position or velocity indicator to indicate vessel position or velocity or deviations in vessel position or velocity; such as a satellite-based positioning system indicator, or accelerometers as a relative position indicator, a heading indicator to indicate vessel heading from position heading or yaw rate or deviations in vessel heading or yaw rate, such as a compass as an absolute heading indicator or a yaw rate sensor as a relative heading indicator, and a controller to control the operation of the waterjet units to substantially maintain the vessel position or velocity, and vessel heading or yaw rate when the dynamic control mode is enabled.

SUMMARY

This Summary is provided to introduce a selection of concepts that are further described herein below in the Detailed Description. This summary is not intended to identify key or essential features of the claimed subject matter, nor is it intended to be used as an aid in limiting the scope of the claimed subject matter.

In one embodiment, a joystick device for controlling propulsion and steering of a marine vessel has a handle configured to be moveable by an operator to provide propulsion and steering control commands for a marine vessel, and a housing at the base of the handle such that the handle extends out of the housing. The joystick device also has an adjustable display thereon that adjusts based on at least one of a control mode and a movement of the handle.

One embodiment of a marine vessel propulsion and steering control system comprises a joystick device having a handle and a housing, the handle configured to be moveable by an operator to control a marine vessel. The control system also has a control unit operably connected to the joystick device that associates a movement of the handle with a control command based on a control mode. The control system also has an adjustable display on the joystick device operated by the control unit based on the control mode.

One embodiment of a method controlling a marine vessel includes providing a joystick device with a moveable handle, a housing, and an adjustable display. A control unit is associated with the joystick device, wherein the joystick device and control unit cooperate to receive control commands to control propulsion and steering of a marine vessel. The method further includes determining a control mode with the control unit, and operating an adjustable display on the joystick device with the control unit according to the control mode.

BRIEF DESCRIPTION OF THE FIGURES

The present disclosure is described with reference to the following Figures. The same numbers are used throughout the Figures to reference like features and like components.

DETAILED DESCRIPTION OF THE DRAWINGS

In the present description, certain terms have been used for brevity, clarity and understanding. No unnecessary limitations are to be inferred therefrom beyond the requirement of the prior art because such terms are used for descriptive purposes only and are intended to be broadly construed.

Figure 1:
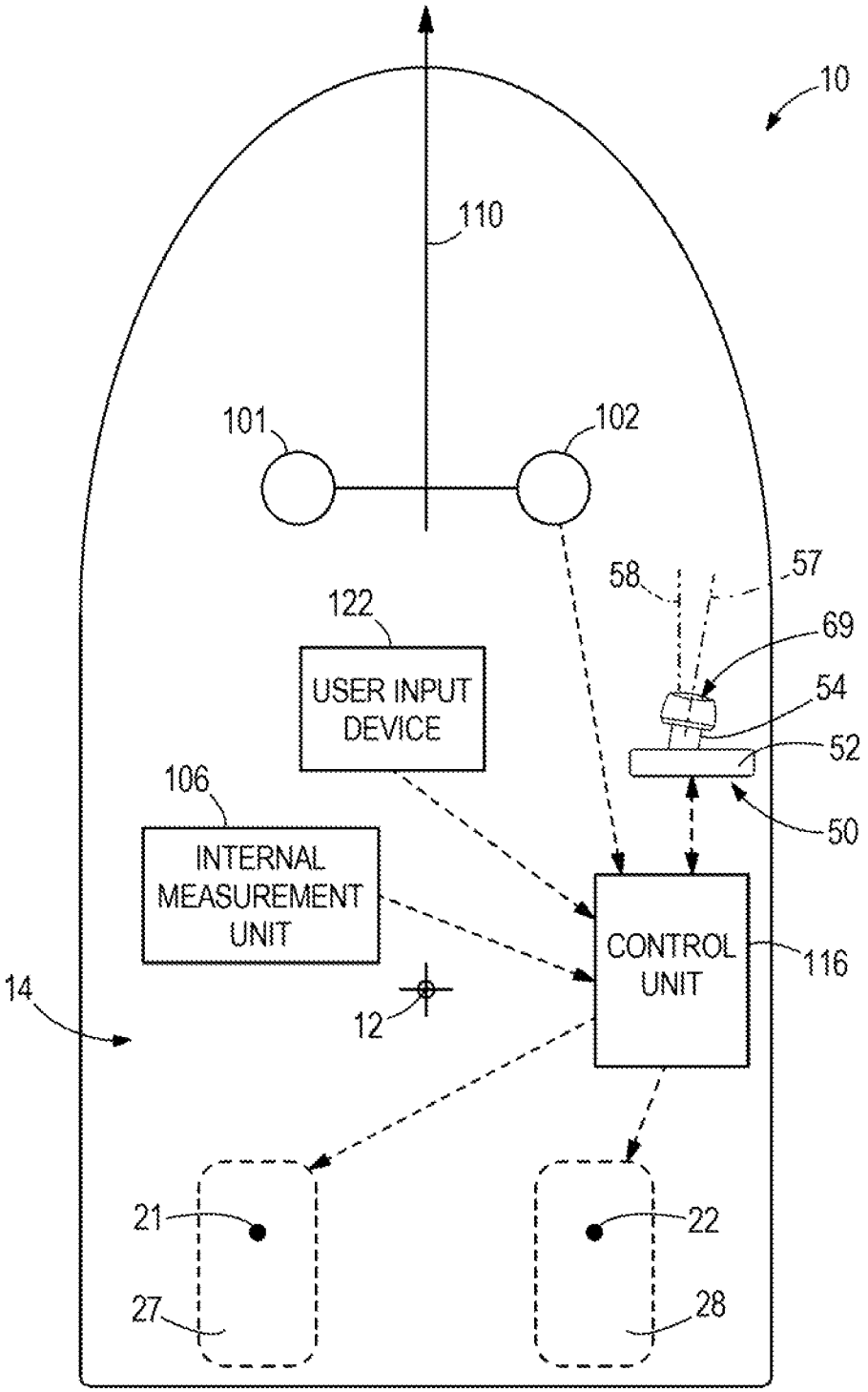
FIG. 1 is a schematic representation of a marine vessel equipped with a propulsion and steering control system including a joystick with an adjustable display.

FIG. 1 schematically depicts an embodiment of a marine vessel 10 having a propulsion and steering control system 14 including a joystick device 50 with an adjustable display 69 thereon. It should be understood that the particular configuration of the marine vessel 10, and the propulsion and steering system 14 shown and described, is one exemplary embodiment of such a system with which a joystick device 50 with an adjustable display 69 may be used. It is possible to apply the concepts described in the present disclosure with substantially different configurations for marine vessels and control systems therefore. For example, the marine vessel 10 depicted in FIG. 1 has first and second propulsion devices 27, 28. It should be understood that the concepts disclosed in the present disclosure are applicable to a marine vessel having any number of marine propulsion devices and any configuration of a propulsion device, such as a propeller, impeller, pod drive, and the like, which may be driven by any marine drive, such as an outboard motor, an inboard drive, or an inboard/outboard drive (or stern drive), as will be apparent to those of ordinary skill in the art. In addition, the control systems described herein include certain operational structures such as global positioning systems (GPS) 101, 102 devices and inertial measurement units (IMUs) 106. It should be understood that such systems may or may not be used in conjunction with the joystick device 50 disclosed herein, and that the concepts disclosed in the present disclosure are capable of being implemented with different types of control systems and are not limited to the propulsion and steering control systems 14 described and depicted herein.

In FIG. 1, a marine vessel 10 having center of gravity along axis 12 is schematically illustrated. The marine vessel 10 has two marine drives 27 and 28, each having a steering axis, 21 and 22 respectively. The operation of the marine drives 27 and 28, including their rotation about steering axes 21 and 22, is controlled by the propulsion and steering control system 14. The propulsion and steering control system 14 includes a global positioning system (GPS) which, in the depicted embodiment, comprises a first GPS device 101 and a second GPS device 102 located at preselected fixed positions on the marine vessel 10 to provide information related to the global position of the marine vessel 10 in terms of latitude and longitude. The GPS system also includes an inertial measurement unit (IMU) 106. The IMU can be, for example, part 8M0048162 available from Mercury Marine, of Fond du Lac, Wis. In certain embodiments, the IMU 106 may comprise a differential correction receiver, accelerometers, angular rate sensors, and a microprocessor which manipulates the information obtained from these devices to provide information relating to the current position of the marine vessel 10 in terms of longitude and latitude, the current heading of the marine vessel 10 (represented by arrow 110), and the velocity and acceleration of the marine vessel 10 in six degrees of freedom.

The propulsion and steering control system 14 further includes a user input device 122 which may be used to provide control commands to control any number of aspects of the propulsion and steering of the marine vessel 10. For example, the user input device 122 may enable a user to provide input to control any one or more of the route, headings, control mode, propulsion speed, gear, direction, and the like. In exemplary embodiments, the user input device 122 may comprise one or more of a display screen, a touch screen, push buttons, a keyboard, or the like. Alternatively or additionally, the user input device 122 may further include remotely operated or wireless devices not physically installed on the marine vessel 10, such as a fob or other type of remote activator or controller. In another embodiment, the user input device 122 may be combined with the joystick device 50, and/or the joystick device 50 may incorporate user input devices other than just the handle 54, as disclosed in certain embodiments herein.

The control system 14 further includes a joystick device 50 having a handle 54 that can move in various directions. The handle 54 extends from a housing 52. In the depicted embodiment, the handle 54 extends upward from the housing 52 along an axis 57. The handle 54 is depicted in a tilted position, away from its upright center axis 58, for example providing a control command to the control unit 116. As will be known to one of skill in the art, the joystick device 50 may be used to control the steering and propulsion system to affect any range of translational and/or rotational motion of the marine vessel 10. Motions of the joystick device 50 include tilt in the forward, back, right, and left directions, and any combinations thereof (such as tilt forward to the right, or back to the left, etc.) and rotation about the axis 57 of the handle 54, which can be combined with the tilt motions. The corresponding motions of the marine vessel 10 as controlled by movements of the joystick device 50 include translational movements in four basic directions, including forward axial motion, reverse axial motion, port lateral motion, starboard lateral motion, and any direction therebetween. A marine vessel 10 may also be controlled by the joystick device 50 to perform rotational movement about a vertical axis of the marine vessel 10, such as axis 12 along the center of gravity of the marine vessel 10. It is to be appreciated that the aforementioned motions of the handle 54 of the joystick device 50 may also invoke other control commands other than steering commands, depending on the control mode of the joystick device 50.

The propulsion and steering control system 14 further includes a control unit 116. The control unit 116 includes a memory, a programmable processor, and programmable input/output peripherals. As is conventional, the processor can be communicatively connected to a computer readable medium that includes volatile and/or nonvolatile memory upon which computer readable code is stored. The processor can access the computer readable code and the computer readable medium upon executing the code carries out functions as described herein below. The control unit 116 is operatively connected to the various elements of the propulsion and steering control system 14, including the GPS device(s) 102, the IMU 106, the user input device(s) 122, the joystick device 50, and the first and second marine drives 27 and 28. The control unit 116 can receive inputs and send outputs via a CAN bus as described in U.S. Pat. No. 6,273,771, which has been incorporated herein by reference. In other examples, the control unit 116 is connected to various portions of the control system 14, as well as other devices on the marine vessel 10, via wireless communication rather than by a wired CAN bus.

In one embodiment, the control unit 116 may receive information from a user input device 122 that allows the operator of the marine vessel 10 to manually select a mode of operation, or a control mode. As an example, the user input device 122 can be an input screen or a set of push buttons that allows the operator of the marine vessel to manually select various modes of operation associated with the marine vessel 10. As is provided herein, such a user input device 122 for selection of a control mode may be integrated into the joystick device 50. The user interface 122 and/or the joystick device 50 may be used by an operator of the marine vessel to select a control mode and provide an enabling signal that informs the control unit 116 that the operator desires to operate the marine vessel 10 in accordance with that control mode. Exemplary control modes may include a station keeping mode that maintains the position of the marine vessel in a selected location, such as at a GPS location and at a particular heading, (referred to herein as "Skyhook mode"). Another exemplary control mode is a direction control mode that maintains or controls the heading of the marine vessel in accordance with a user selected heading (referred to herein as "Heading mode"). Another exemplary control mode includes a route-planning mode that controls the heading and/or propulsion of the marine vessel 10 in order to execute a user selected route plan (referred to herein as "Route mode"). Such control modes are known in the art and examples are described in the prior art references incorporated herein, including at U.S. Pat. Nos. 8,417,399, 7,305,928, 8,050,630, 8,478,464, and 8,924,054. Further exemplary description of such control modes is provided at U.S. Pat. Nos. 6,885,919 and 5,884,213, which are hereby incorporated herein by reference in their entireties.

As will be described in further detail below, the joystick device 50 and/or control unit 116 may be configured to variously allow an operator to use the joystick device 50, and particularly the handle 54, to manually steer or maneuver the marine vessel 10, or to adjust the station, heading, route, speed, or the like, depending on the selected control mode.

The joystick device 50 has one or more adjustable displays 69 which may be on the handle 54 or the housing 52 of the joystick. The adjustable display 69 may be adjusted based on the control mode and/or in response to movement of the handle 54. For example, the adjustable display 69 may variously display a mode indicator 71 that indicates an activated control mode (e.g., "Skyhook," "Route," or "Heading"), receipt and/or execution of a control command (e.g., to indicate a direction of a steering control command), or available control options 72 (e.g., indicating the control commands associated with certain movements of the handle 54). The adjustable display 69 may be located anywhere on the joystick, including the handle 54 and the housing 52, and may be any type of display that is adjustable to display information as described herein. In exemplary embodiments, the adjustable display 69 may comprise any one or more of an adjustable indicator light or an electronic display, such as a light-emitting diode (LED) display, a liquid-crystal display (LCD), an electronic-paper display, an electro-luminescent display (ELD), or a plasma-display panel (PDP). In one such embodiment, the adjustable display may be a set of indicator lights that are independently illuminable to indicate the control mode of the joystick device 50 or control options 72 available to an operator 44 by moving the handle 54 in specified directions. In certain embodiments, each mode indicator 71 and/or control option 72 may have a unique configuration and/or color.

Figure 2:
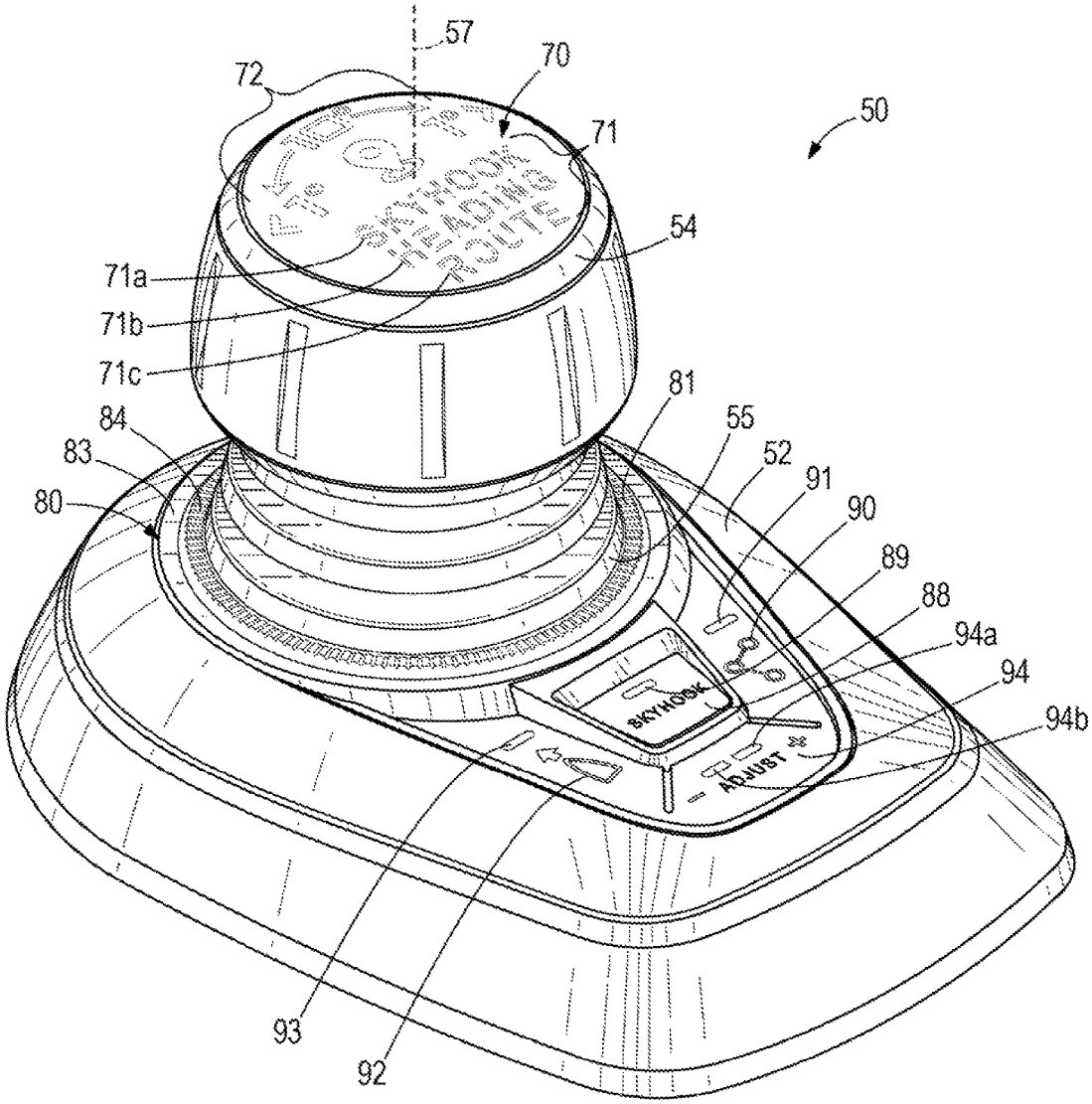
FIG. 2 illustrates one embodiment of a joystick with an adjustable display.

FIG. 2 depicts an exemplary embodiment of a joystick device 50 having handle 54 and housing 52. The depicted embodiment has two adjustable displays, an upper display 70 on a top portion of the handle 54 and a lower display 80 on the housing 52 at the base 55 of handle 54. The joystick device 50 may have additional user interface elements thereon, such as push buttons or touch screen elements for selecting a control mode. In the embodiment of FIG. 2, the joystick device 50 has four push buttons, including a Skyhook button 88, a Route button 90, a Heading button 92, and an Adjust button 94. Each button has an activation indicator light associated therewith that indicates whether the associated control mode is activated or not. Specifically, the skyhook button 88 has a Skyhook activation indicator light 89 associated therewith. The Route button 90 has Route activation indicator light 91 associated therewith. The Heading button 92 has Heading activation indicator light 93 associated therewith. The adjust button 94 has two adjust indicator lights 95*a* and 95*b* associated therewith. Such indicator lights may be used alone or in conjunction with the adjustable display 69, which in various embodiments may be the upper display 70 or the lower display 80, to indicate the currently-activated control mode for the joystick device 50.

Figure 3:
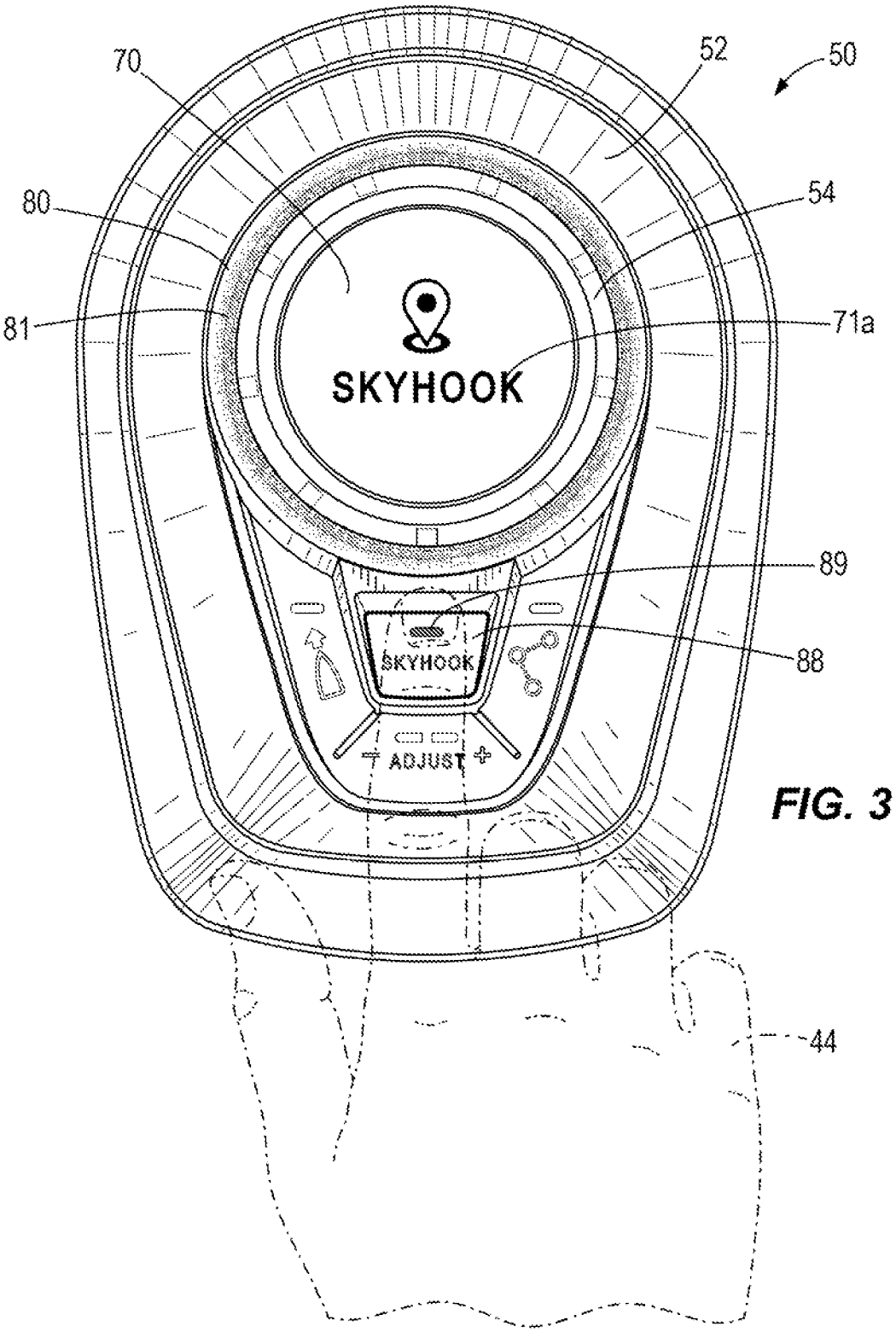
FIG. 3 illustrates another embodiment of a joystick with an adjustable display.

In the embodiment of FIG. 2, the upper display 70 is adjustable to provide mode indicators 71 and control options 72. For example, the upper display 70 may provide a Skyhook mode indicator 71*a* when the joystick device 50 is operating in Skyhook mode, a Heading mode indicator 71*b* when the joystick device is in Heading mode, and a Route mode indicator 71*c* when the joystick device 50 is operating in Route mode. FIG. 3 illustrates an exemplary scenario wherein the joystick 50 of FIG. 2 is in Skyhook mode. As shown in FIG. 3, an operator 44 may depress the Skyhook button 88 to activate Skyhook mode. Upon activation of the Skyhook mode, the Skyhook activation indicator light 89 becomes illuminated and the upper display 70 is operated to provide the Skyhook mode indicator 71*a*. As explained above, the Skyhook mode indicator 71*a* may be an indicator light that is illuminated on the handle 54 to tell the operator 44 that the joystick device 50 is operating in Skyhook mode. In other embodiments, the upper display 70 may be an electronic display that adjusts to display the Skyhook mode indicator 71*a*.

Figure 4:
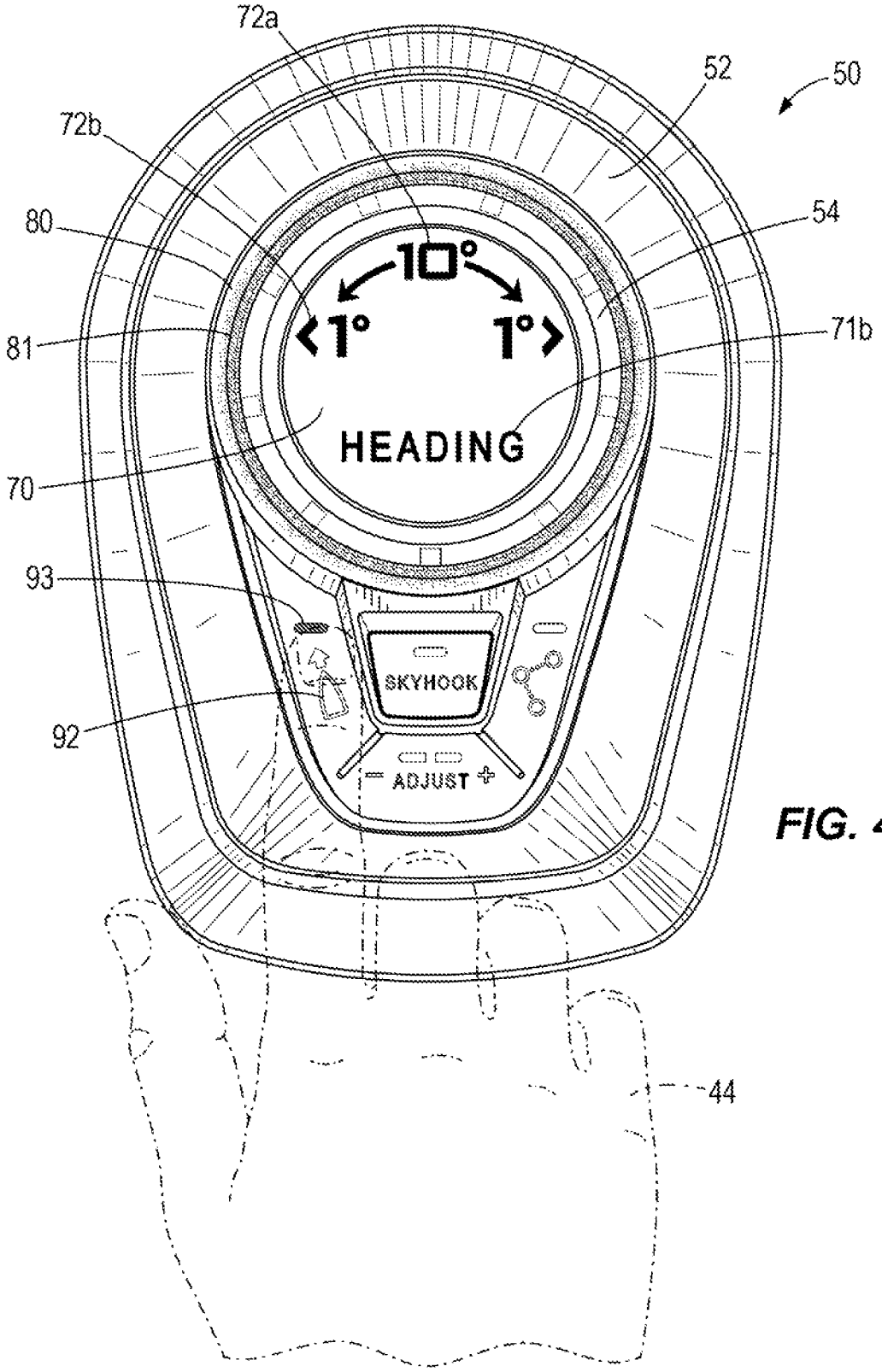
FIG. 4 illustrates another embodiment of a joystick with an adjustable display.

Alternatively or additionally, the adjustable display 69 may include a lower display 80, which may also be used to indicate the control mode, receipt of a control instruction, and/or control options 72. In the embodiment of FIGS. 2-4, the lower display 80 is an illuminable ring 81, which is a circular light display that surrounds the base 55 of the handle 54. The illuminable ring 81 may be illuminated in its entirety, or portions of the illuminable ring 81 may be illuminated. For example, the illuminable ring 81 may blink, provide a trailing light around the circumference in a clockwise or counter-clockwise direction, or may otherwise provide an illumination pattern that indicates a particular mode, receipt of a control command, or to present a control option. Furthermore, the illuminable ring 81 may be illuminated in one or more different colors, which may further be employed to convey information about the control mode, control commands, and/or control options.

In the embodiment shown in FIG. 3, for example, the illuminable ring 81 may be illuminated in a particular color and/or pattern that uniquely indicates that the joystick device 50 is in Skyhook mode. In one exemplary embodiment, the Skyhook mode indicator 71*a* displays in blue on the upper display 70, which is on the top portion of the handle 54, and the illuminable ring 81 of the lower display 80 illuminates or flashes around the base 55 of the handle 54 in the same blue color. In such an embodiment, the color blue provides a further indicator that the joystick device 50 is in Skyhook mode, and such an indicator may be especially beneficial because it is visible from a significant distance.

Turning to FIG. 4, the upper display 70 and the lower display 80 may similarly be adjusted to indicate the control mode when the operator 44 presses the Heading button 92. Thereafter, the Heading activation indicator light 93 on the Heading button 92 illuminates and the upper and lower displays 70 and 80 are adjusted to indicate that the joystick device 50 is in Heading mode. In the exemplary embodiment of FIG. 4, the upper display 70 presents Heading mode indicator 71*b* as well as control options 72*a* and 72*b*. Likewise, the illumination ring 81 of the lower display 80 may illuminate in a particular color or pattern to indicate Heading mode.

In the exemplary embodiment of FIG. 4, the upper display 70 presents control options 72*a* and 72*b* in Heading mode to indicate to the operator 44 options for adjusting the current heading 110 of the marine vessel 10. Control options 72*a* indicates to the operator 44 that turning the handle 54 in a clockwise or counter-clockwise direction about axis 57 adjusts the heading by 100. Specifically, turning the handle 54 in a clockwise direction adjusts the heading in the starboard direction by 10°, and turning the handle 54 in the counter-clockwise direction about axis 57 adjusts the heading by 10° in the port direction. Likewise, the control options 72 indicate to the operator 44 that tilting, or pushing, the joystick rightward adjusts the heading in the starboard direction by 1°, and pushing the joystick to the left adjusts the heading the port direction by 1°. In other embodiments, the control options 72 may be presented differently, or different control options may be presented to convey to the user what control command will be associated with various movements of the handle 54. In other embodiments, control options 72 may take any form that conveys to the user a control command associated with a particular movement of the handle. For example, in Skyhook mode, the adjustable display 69 may indicate how the handle 54 can be operated to adjust the position of the marine vessel, including the GPS location and/or the heading. As another example, control options 72 could be presented on the adjustable display 69 in Route mode to indicate how the operator 44 can move the handle 54 to adjust the boat propulsion speed, route, and/or current heading, for example.

In reference to FIGS. 2-5, the adjustable display 69 may be a lower display 80 on the housing 52 of the joystick device 50. The lower display 80 may be any type of display that is adjustable to indicate a control mode and/or movement of the handle 54 to provide control commands. In the embodiments of FIGS. 2-4, the lower display 80 is an illuminable ring 81 as is described above. The illuminable ring 81 may be at the base 55 of the handle 54, as shown, or may be a ring around any portion of the housing 52. In still other embodiments, the upper display 70 could be an illuminable ring 81 on a top portion of the handle 54 of the joystick device 50. As described above, the illuminable ring 81 may present various light colors and/or patterns to present information to the operator 44. In one embodiment, the illuminable ring 81 is constructed using light-emitting diodes (LEDs) housed beneath the base 55 of the handle 54 with a light deflecting bezel 83 that reflects and disperses the light from the one or more LEDs to illuminate a portion of the ring or the entire illuminable ring. In other embodiments, the illuminable ring 81 is constructed of an LED ring 84, or a chain of several LEDs around the base 55 of the handle 54 or on another location on the joystick device 50. In such an embodiment, one or more of the LEDs in the LED ring 84 can illuminate in isolation to illuminate a smaller or larger portion of the illuminable ring 81, enabling the creation of animated light patterns which can indicate information to the operator 44. In other embodiments, the illuminable ring 81 may be an electronic display, such as of the types described above, providing a circular illumination pattern. A reflective bezel 83 may also be provided to reflect and disperse the light patterns to make them more visible to an operator looking down on the joystick device 50.

In one embodiment, the illuminable ring 81 may illuminate to indicate receipt of a control command, such as a direction of a steering control command. In such an embodiment, a portion of the illuminable ring 81 may light up in response to an operator 44 moving the handle 54 to provide a steering instruction. For example, if the handle 54 is pushed, or tilted, rightward, providing an instruction to steer the marine vessel 10 in the starboard direction, a portion of the right side of the illuminable ring 81 may light up. That could be repeated for any directional steering control command provided by the operator 44. Alternatively or additionally, if the user rotates the handle 54 about its axis 57 to rotate the boat in place, for example, about its center of gravity 12, the illuminable ring 81 may provide a trailing circular light in the direction that the handle 54 is being rotated. In other embodiments, the illuminable ring 81 may flash, such as to indicate activation of a control mode, receipt of a control command, or an error. In one embodiment, the illuminable ring 81 may flash in a particular color to indicate activation of a control mode, and may flash in a different color, such as red, to indicate when an error has occurred, such as receipt of an improper control command or an inability to activate a control mode.

Figure 5:
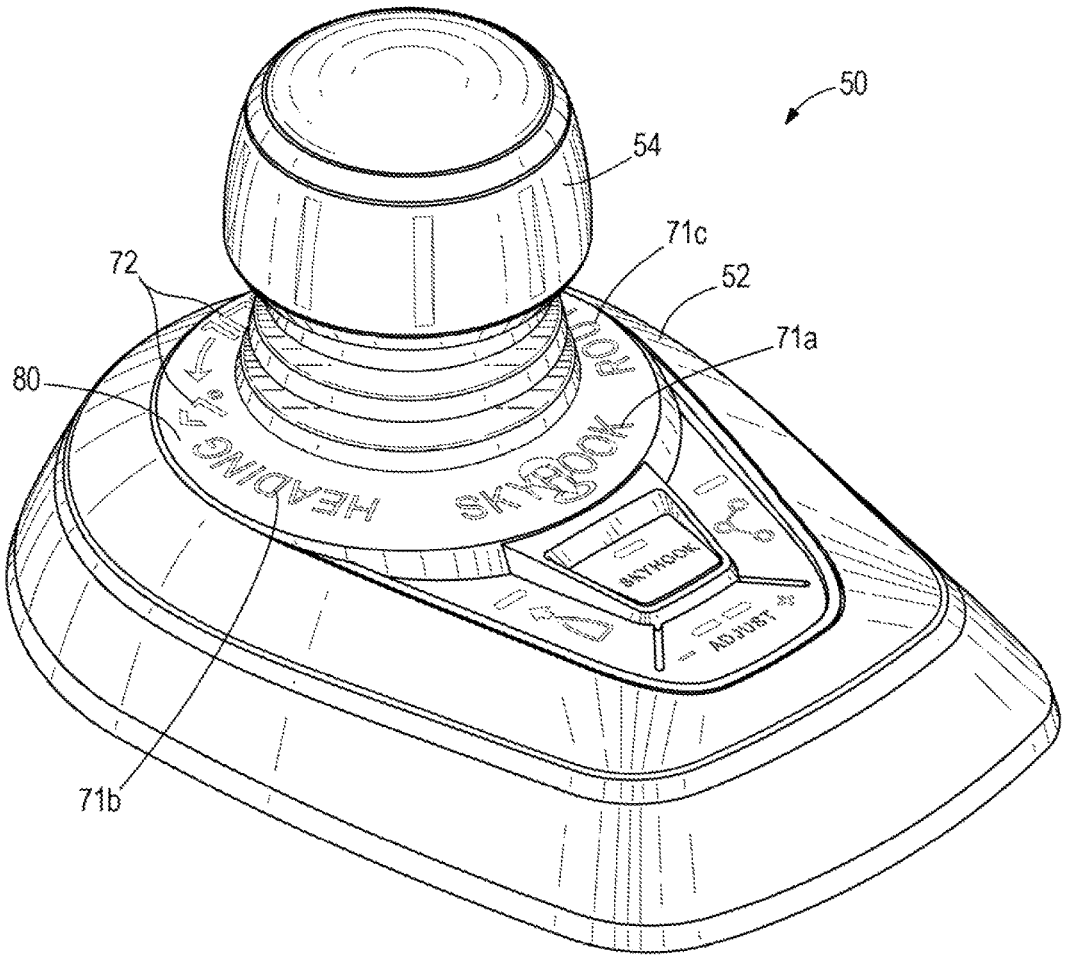
FIG. 5 illustrates another embodiment of a joystick with an adjustable display.
Figure 6:
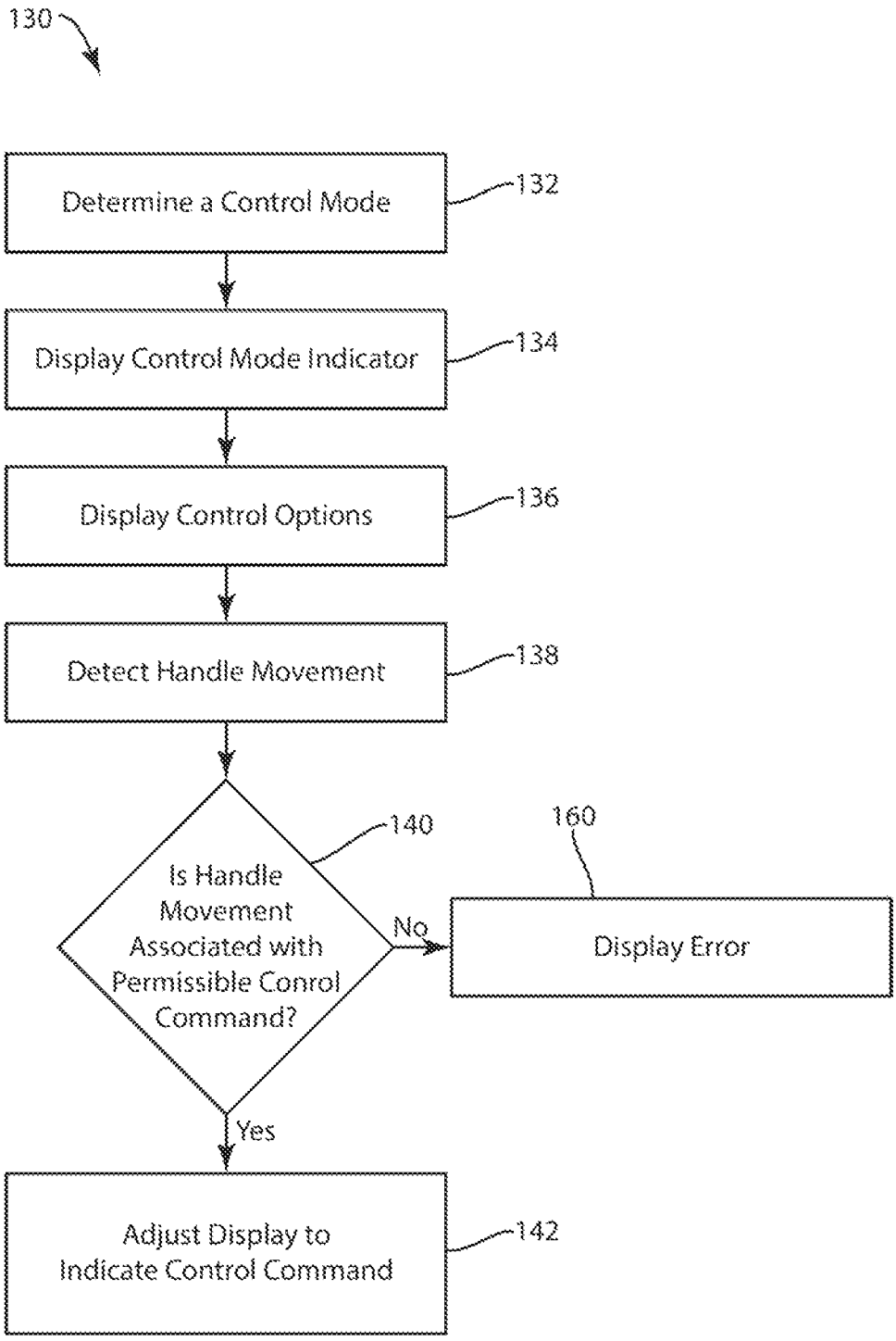
FIG. 6 illustrates one embodiment of a method of controlling a marine vessel.
Figure 7:
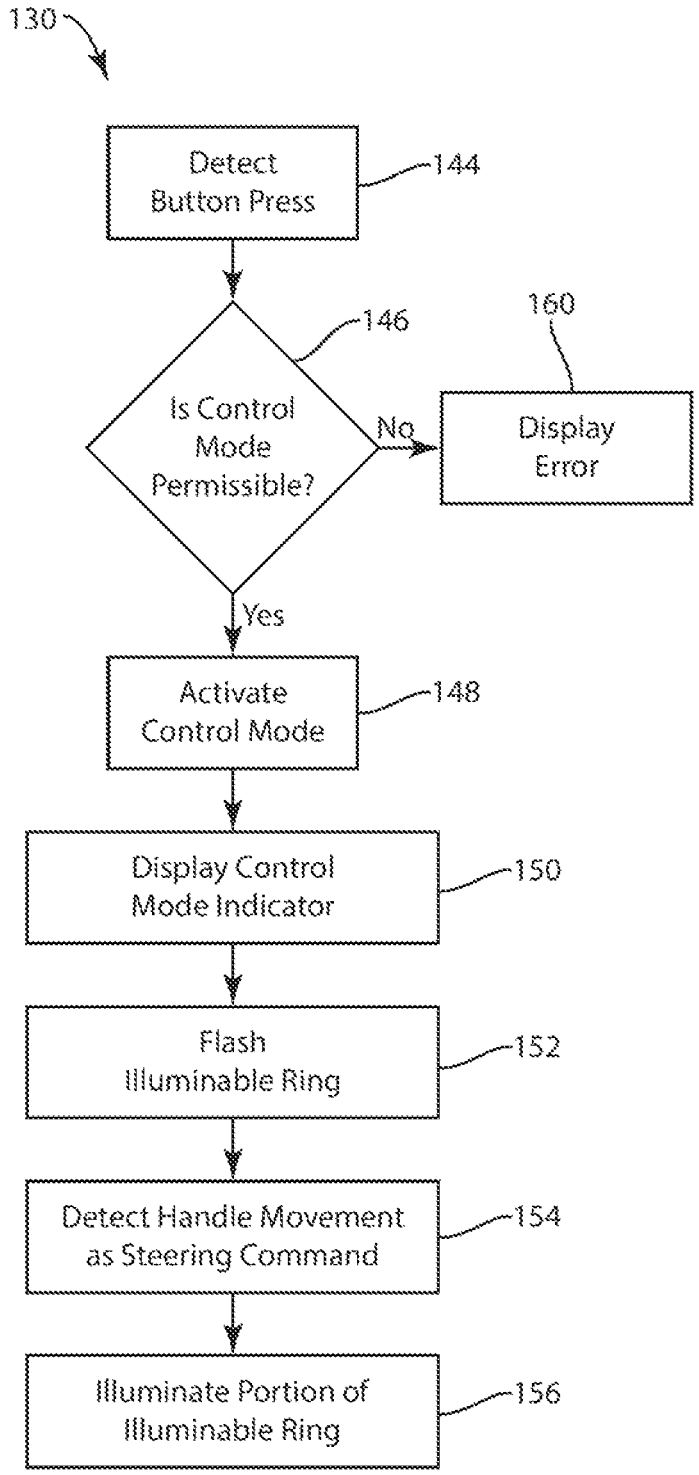
FIG. 7 illustrates another embodiment of a method of controlling a marine vessel.

The lower display 80 may take a form different than the illuminable ring 81. FIG. 5 provides one example of an embodiment of a lower display 80 providing mode indicators 71, including the Skyhook mode indicator 71*a*, Heading mode indicator 71*b*, and Route mode indicator 71*c*, as well as various control options 72. In such an embodiment, the lower display 80 may be a set of one or more light indicators, or it may be an adjustable electronic display, such as the embodiments described above with respect to the upper display 70. In an embodiment such as that in FIG. 5, the lower display 80 may be in addition to an upper display 70, or it may be in place of an upper display 70 such that there is no display on the top portion of the handle 54. A lower display 80 such as that shown in FIG. 5, may be provided in addition to or in place of the illuminable ring 81. In an exemplary embodiment where the lower display 80 is an electronic display surrounding the base 55 of the handle 54, the electronic display may be operated to provide the illuminable ring 81 and/or other illumination patterns around the base 55 to indicate an active control mode, receipt of a control command, available control options, and/or indicate an error.

One embodiment of a method 130 of controlling a marine vessel 10 includes determining a control mode at step 132. Such determination may be made, for example, with the control unit 116 in response to input received from an operator 44 via user input device 122 and/or joystick device 50. At step 134, a control mode indicator 71 is displayed on the adjustable display 69 of the joystick device 50. Control options 72 are also displayed on the adjustable display 69 at step 136. At step 138, movement of the handle 54 is detected. At step 140, the control unit assesses whether the detected handle movement is associated with a permissible control command. If the control command is permissible, then the adjustable display 69 is adjusted to indicate the control command at step 142. If the control command associated with the handle movement is not permissible, then an error indicator is displayed on the adjustable display 69 at step 160. In various examples, the error indicator may include the word "error", may indicate instructions or otherwise describe the error, may be a flashing of the adjustable display, or the like. In embodiments having an illuminable ring 81, for example, the ring may illuminate in a certain color or pattern to indicate an error.

Another embodiment of a method 130 of controlling a marine vessel 10 includes detecting a button press by an operator at step 144 to engage a control mode. The button may be on the joystick device 50, such as that shown in FIGS. 2-5, or may be on a separate user input device 122. At step 146, the control unit 116 determines whether activation of the control mode associated with the button press is permissible. If the control mode is permissible, the control unit 116 activates the control mode at step 148 and displays the associated control mode indicator 71 on the adjustable display 69 of the joystick device 50 at step 150. At step 152, the control unit 116 also operates the illuminable ring 81 to flash, thereby also indicating activation of the control mode. Returning to step 146, if the control mode associated with the button press is not permissible, then an error is displayed at step 160. An example of an impermissible control mode could be if the operator 44 presses the Skyhook button 88 to activate the Skyhook mode (station-keeping mode) when the marine vessel 10 is moving above a predefined limit. At step 154, movement of the handle 54 is detected as a steering command. In response thereto, at step 156 the control unit illuminates a portion of the illuminable ring 81 associated with the direction of the steering command.

In the above description, certain terms have been used for brevity, clarity, and understanding. No unnecessary limitations are to be inferred therefrom beyond the requirement of the prior art because such terms are used for descriptive purposes and are intended to be broadly construed. The different assemblies described herein may be used alone or in combination with other assemblies. It is to be expected that various equivalents, alternatives and modifications are possible within the scope of the appended claims.

We claim:

1. A joystick device for controlling propulsion and steering of a marine vessel, the joystick device comprising:

a handle configured to be movable by an operator to provide propulsion and steering control commands for a marine vessel;

a housing at a base of the handle such that the handle extends out of the housing;

an adjustable display on the joystick device, wherein the adjustable display includes at least one of an upper display on a top portion of the handle or a lower display on the housing that extends around a base of the handle; and a control unit configured to modify the adjustable display based on movement of the handle by the operator.

2. The joystick device of claim 1, wherein the adjustable display indicates a control command provided by the movement of the handle by the operator.

3. The joystick device of claim 1, wherein the adjustable display is one of a light emitting diode (LED) display, a liquid crystal display (LCD), an electronic paper display, an electroluminescent display (ELD), or a plasma display panel (PDP).

4. The joystick device of claim 1, wherein the adjustable display indicates a direction of the movement of the handle providing a control command.

5. The joystick device of claim 1, wherein the adjustable display includes an illuminable ring, and the control unit controls the illuminable ring to illuminate at least a portion thereof in response to the movement of the handle.

6. The joystick device of claim 5, wherein the lower display includes an illuminable ring.

7. A marine vessel propulsion and steering control system comprising:

a joystick device having a handle and a housing, the handle configured to be movable by an operator;

a control unit operably connected to the joystick device that associates a movement of the handle with a control command to control propulsion and steering of a marine vessel based on a control mode; and an adjustable display on the housing of the joystick device and extending around a base of the handle, wherein the adjustable display is operated by the control unit based on the control mode.

8. The marine vessel propulsion and steering control system of claim 7, wherein the adjustable display is one of a light emitting diode (LED) display, a liquid crystal display (LCD), an electronic paper display, an electroluminescent display (ELD), or a plasma display panel (PDP).

9. The marine vessel propulsion and steering control system of claim 7, further comprising an upper display on a top portion of the handle operated by the control unit based on the control mode.

10. The marine vessel propulsion and steering control system of claim 7, wherein the adjustable display is an illuminable ring, and wherein the control unit illuminates at least a portion of the illuminable ring based on the control mode.

11. The marine vessel propulsion and steering control system of claim 7, wherein the control unit adjusts the adjustable display in response to movement of the handle by an operator.

12. The marine vessel propulsion and steering control system of claim 11, wherein the control unit controls the adjustable display in response to the movement of the handle to indicate receipt of a valid control command and/or to indicate that the movement is not associated with a permissible control command.

13. The marine vessel propulsion and steering control system of claim 12, wherein the adjustable display is an illuminable ring; and wherein the control unit illuminates a portion of the illuminable ring associated with a direction of movement of the handle to indicate the receipt of the valid control command.

14. A method of controlling a marine vessel, the method comprising the steps of:

providing a joystick device, comprising a movable handle, a housing, and an adjustable display, and a control unit associated with the joystick device, the joystick device and control unit configured to cooperate to receive control commands to control propulsion and steering of a marine vessel;

wherein the adjustable display includes an illuminable ring;

determining a control mode for the joystick device with the control unit;

detecting a movement of the handle by an operator, and illuminating at least a portion of the illuminable ring on the joystick device with the control unit in response to the movement of the handle.

15. The method of claim 14, further comprising illuminating at least a portion of the illuminable ring on the joystick device with the control unit to indicate at least one of the control mode, a control option, and an error.

16. The method of claim 14, further comprising determining that the movement of the handle is not associated with a permissible control command; and wherein the step of illuminating the illuminable ring on the joystick device with the control unit in response to the movement of the handle includes illuminating the illuminable ring to indicate and error.

17. The method of claim 14, wherein the step of illuminating the illuminable ring on the joystick device with the control unit in response to the movement of the handle includes illuminating the illuminable ring in response to receipt of a valid steering command.

18. The method of claim 17, wherein illuminating the illuminable ring in response to receipt of a valid steering command includes illuminating a portion of the illuminable ring associated with a direction of the steering command.

19. The method of claim 14, wherein the adjustable display includes an upper display on a top portion of the joystick and a lower display on the housing;

wherein the lower display is the illuminable ring and the upper display is one of a light emitting diode (LED) display, a liquid crystal display (LCD), an electronic paper display, an electroluminescent display (ELD), or a plasma display panel (PDP); and further comprising adjusting the adjustable display in response to the control command by indicating the control mode on the upper display and illuminating at least a portion of the illuminable ring of the lower display.

* * * * *